US011906182B2

(12) United States Patent
Hui et al.

(10) Patent No.: US 11,906,182 B2
(45) Date of Patent: Feb. 20, 2024

(54) SCORING A BUILDING'S ATMOSPHERIC ENVIRONMENT

(71) Applicant: Carrier Corporation, Palm Beach Gardens, FL (US)

(72) Inventors: Daniel Hui, New York, NY (US); Mary Rockwell, Brooklyn, NY (US); Anya Palkowski, Brooklyn, NY (US); Madeline Winer, New York, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/654,394

(22) Filed: Mar. 10, 2022

(65) Prior Publication Data

US 2022/0316730 A1 Oct. 6, 2022

Related U.S. Application Data

(60) Provisional application No. 63/170,357, filed on Apr. 2, 2021.

(51) Int. Cl.
*F24F 11/32* (2018.01)
*F24F 11/49* (2018.01)

(52) U.S. Cl.
CPC ..... *F24F 11/32* (2018.01); *F24F 11/49* (2018.01)

(58) Field of Classification Search
CPC ..... F24F 11/30; F24F 11/56; F24F 2110/70; F24F 11/0001; F24F 2110/66;
(Continued)

(56) References Cited

U.S. PATENT DOCUMENTS 8,106,769 B1 1/2012 Maroney et al.
8,731,724 B2 5/2014 Drees et al.
(Continued)

FOREIGN PATENT DOCUMENTS

CN 210664344 U 6/2020
CN 112418819 A 2/2021
(Continued)

OTHER PUBLICATIONS

Extended European Search Report dated Aug. 11, 2022, received for European Application No. 22166481.6, pages.

*Primary Examiner* — Darrin D Dunn
(74) *Attorney, Agent, or Firm* — Kinney & Lange, P.A.

(57) ABSTRACT

Apparatus and associated methods relate to calculating a single composite score that indicates an atmospheric environment quality level of a building. Such a composite score is calculated using sensors from three distinct types of atmospheric environmental categories: i) thermal comfort; ii) ventilation; and iii) air quality. Because the sensors used to detect these distinct types of atmospheric environmental categories are indicative of dissimilar metrics of quality of the atmospheric environment, the dissimilar metrics are normalized so as to be combinable. The dissimilar metrics are normalized based on measures of acceptability of the metrics. Each of the dissimilar metrics is given the same normalized score when the dissimilar metrics correspond to the same level of acceptability for that metric. The levels of acceptability may be determined based on one or more building industry standards.

20 Claims, 5 Drawing Sheets

(58) Field of Classification Search
CPC ..... F24F 2120/00; F24F 11/33; F24F 2011/0002; F24F 2110/00; F24F 2110/22; F24F 2110/50; F24F 2110/64; F24F 2110/65; G05B 15/02; G05B 2219/2642; G05B 19/042; H04L 12/2803; H04L 12/2827
See application file for complete search history.

(56) References Cited

U.S. PATENT DOCUMENTS

| | | | | |
|---|---|---|---|---|
| 9,280,884 | B1 * | 3/2016 | Schultz | G01N 33/0063 |
| 9,441,850 | B2 * | 9/2016 | Sato | F24F 3/065 |
| 9,618,224 | B2 * | 4/2017 | Emmons | F24F 11/62 |
| 10,042,341 | B1 | 8/2018 | Jacob | |
| 10,222,360 | B1 * | 3/2019 | Nourbakhsh | G01N 33/0075 |
| 10,387,966 | B1 | 8/2019 | Olander et al. | |
| 10,510,121 | B2 | 12/2019 | Allen et al. | |
| 10,712,030 | B2 * | 7/2020 | Yamamoto | F24F 11/74 |
| 10,767,876 | B2 * | 9/2020 | Kelly | F24F 11/30 |
| 10,890,904 | B2 | 1/2021 | Turney et al. | |
| 11,137,163 | B2 * | 10/2021 | Nasis | G01N 33/0047 |
| 11,566,801 | B2 * | 1/2023 | Forzani | F24F 11/0001 |
| 2006/0173580 | A1 * | 8/2006 | Desrochers | G01N 33/0034 73/31.01 |
| 2014/0081467 | A1 * | 3/2014 | Sato | F24F 11/62 700/276 |
| 2014/0136242 | A1 | 5/2014 | Weekes et al. | |
| 2014/0279574 | A1 * | 9/2014 | Gettings | G06Q 50/16 705/306 |
| 2015/0032264 | A1 * | 1/2015 | Emmons | F24F 11/0001 700/276 |
| 2015/0178865 | A1 | 6/2015 | Wu et al. | |
| 2016/0231014 | A1 * | 8/2016 | Ro | F24F 11/62 |
| 2017/0038088 | A1 * | 2/2017 | Korber | G06F 16/24578 |
| 2018/0299150 | A1 * | 10/2018 | Ajax | F24F 11/0008 |
| 2018/0328615 | A1 * | 11/2018 | Lo | F24F 11/745 |
| 2019/0017720 | A1 * | 1/2019 | Otsuki | F24F 11/65 |
| 2019/0024916 | A1 * | 1/2019 | Yamamoto | F24F 11/56 |
| 2019/0154285 | A1 | 5/2019 | Pham et al. | |
| 2019/0234637 | A1 | 8/2019 | Bentz et al. | |
| 2019/0277530 | A1 | 9/2019 | Schwegler et al. | |
| 2020/0072694 | A1 | 3/2020 | Melink et al. | |
| 2020/0182505 | A1 * | 6/2020 | Shinozaki | F24F 11/83 |
| 2020/0284930 | A1 | 9/2020 | Hida et al. | |
| 2020/0286350 | A1 | 9/2020 | Heintzelman et al. | |
| 2020/0387151 | A1 | 12/2020 | Chabukswar et al. | |
| 2020/0400328 | A1 * | 12/2020 | Zhou | F24F 11/56 |
| 2021/0003304 | A1 * | 1/2021 | Hamada | F24F 11/62 |
| 2021/0018210 | A1 * | 1/2021 | Nasis | G01N 33/004 |
| 2021/0041124 | A1 | 2/2021 | Ajax et al. | |
| 2021/0095881 | A1 * | 4/2021 | Lian | F24F 11/77 |
| 2022/0003447 | A1 * | 1/2022 | Williams | F24F 11/46 |
| 2022/0042694 | A1 * | 2/2022 | He | F24F 11/88 |
| 2022/0136717 | A1 * | 5/2022 | Wenger | F24F 11/30 423/220 |
| 2022/0252293 | A1 * | 8/2022 | Nasis | G01N 33/0047 |
| 2022/0299234 | A1 * | 9/2022 | Basterash | F24F 11/74 |
| 2022/0300871 | A1 * | 9/2022 | Nayak | G06Q 10/0633 |

FOREIGN PATENT DOCUMENTS

| | | | |
|---|---|---|---|
| DE | 10215650 | A1 | 11/2003 |
| WO | 2018191716 | A1 | 10/2018 |

* cited by examiner

Section A
Score Composition

Section B
Component Thresholds & Scale

Section C
Component Score Formula

50

Section D
Composite Score

| (A) Score Composition | | | (B) Component Thresholds & Scale | | | (C) Component Score Formulas | | | | (D) Composite Score | |
|---|---|---|---|---|---|---|---|---|---|---|---|
| | | | Enhanced Threshold | Acceptable Threshold | Warning Threshold | High Score Range Formula (Max: 100) | | Low Score Range Formula (Min: 0) | | Weights within Category | Category Weights |
| **Category** | | Score > | B2 90 | B1 75 | B3 60 | $m_{HIGH}$ Input x | $b_{HIGH}$ | $m_{LOW}$ Input x | $b_{LOW}$ | | |
| A1 **Thermal Comfort** | Indoor Air Temperature 1 | 3 PMV Predicted Mean Vote | 7 +/- 0.5 | 11 +/- 1 | 13 +/- 2 | 1 (ABS Value) x -30.00 | 105.00 | 2 (ABS Value) x -15.00 | 90.00 | N/A | 5 33.33% |
| | Humidity 2 | | | | | | | | | | |
| A2 **Ventilation** | Carbon Dioxide 4 | ppm | 8 750 | 2 900 | 14 1000 | -0.10 | 3 165.00 | -0.150000 | 4 210.0000 | N/A | 6 33.33% |
| A3 **Air Quality** | PM 2.5 5 | µg/m3 | 9 12 | 3 15 | 15 35 | -5.00 | 5 150.00 | -0.75 | 6 86.25 | 1 Take the Minimum Individual Score within Category | 7 33.33% |
| | TVOC 7 | µg/m3 | 11 200 | 5 500 | 17 2000 | -0.050 | 9 100.00 | -0.01 | 10 80.00 | | |
| | Radon 8 | pCi/L | 12 2 | 6 4 | 18 8 | -7.50 | 11 105.00 | -3.75 | 12 90.00 | | |

FIG. 2

SCORING A BUILDING'S ATMOSPHERIC ENVIRONMENT

CROSS-REFERENCE TO RELATED APPLICATION(S)

This application claims the benefit of U.S. Provisional Application No. 63/170,357 filed on Apr. 2, 2021, which is incorporated by reference in its entirety.

BACKGROUND

A building's atmospheric environment is controlled so as to provide a safe and comfortable environment for persons who have occasion to be present therein. These atmospheric environments can be controlled in various manners. For example, temperature of a building's atmospheric environment can be controlled in response to temperature measurements obtained at various locations within the building. Similarly, humidity of a building's atmospheric environment can be controlled in response to humidity measurements obtained at various locations within the building. Each metric of the building's atmosphere can be individually controlled in response to the measurements pertaining to that particular metric (e.g., temperature or humidity, etc.). Safety and/or comfort pertaining to the building's atmospheric environment, however, can be determined based on more complex combinations of various metrics of the atmospheric environment therein.

SUMMARY

Apparatus and associated methods relate to a system for scoring an atmospheric environment within a building. The system includes a processor and computer-readable memory. The computer-readable memory is encoded with instructions that, when executed by the processor, causes the system to: i) receive a first signal from a first sensor, the first signal indicative of thermal comfort; ii) receive a second signal from a second sensor, the second signal indicative of ventilation; iii) receive a third signal from a third sensor, the third signal indicative of air quality; iv) convert the received first, second, and third signals to first, second, and third normalized scores, respectively; v) combine the first, second, and third normalized scores to a single composite score indicative of the atmospheric environment in the building; and vi) send a signal indicative of the composite score to a display device so as to provide notification of the atmospheric environment to a user.

Some embodiments relate to a system for scoring an atmospheric environment within a building. The system includes a processor and computer-readable memory. The computer-readable memory is encoded with instructions that, when executed by the processor, causes the system to: i) receive a first plurality of signals from a first plurality of sensors, each of the first plurality of signals indicative of thermal comfort in a corresponding one of a plurality of building zones; ii) receive a second plurality of signals from a second plurality of sensors, each of the second plurality of signals indicative of ventilation in the corresponding one of the plurality of building zones; iii) receive a third plurality of signals from a third plurality of sensors, each of the third plurality of signals indicative of air quality in the corresponding one of the plurality of building zones; iv) convert corresponding ones of the received first, second, and third plurality of signals to first, second, and third pluralities of normalized scores, respectively; v) combine the first, second, and third pluralities of normalized scores to a plurality of composite scores indicative of the atmospheric environment in the corresponding one of the plurality of building zones; and vi) send signals indicative of the plurality of composite scores to a display device so as to provide notification of the atmospheric environment in at least one of the plurality of building zones to a user.

BRIEF DESCRIPTION OF THE DRAWINGS

FIG. 2 is a chart that displays how a composite score can be determined from sensors providing metrics of thermal comfort, ventilation, and air quality.

DETAILED DESCRIPTION

Apparatus and associated methods relate to calculating a single composite score that indicates an atmospheric environment quality level of a building. Such a composite score is calculated using sensors from three distinct types of atmospheric environmental categories: i) thermal comfort; ii) ventilation; and iii) air quality. Because the sensors used to detect these distinct types of atmospheric environmental categories are indicative of dissimilar metrics of quality of the atmospheric environment, the dissimilar metrics are normalized so as to be combinable. The dissimilar metrics are normalized based on measures of acceptability of the metrics. Each of the dissimilar metrics is given the same normalized score when the dissimilar metrics correspond to the same level of acceptability for that metric. The levels of acceptability may be determined based on one or more building industry standards.

Figure 1:
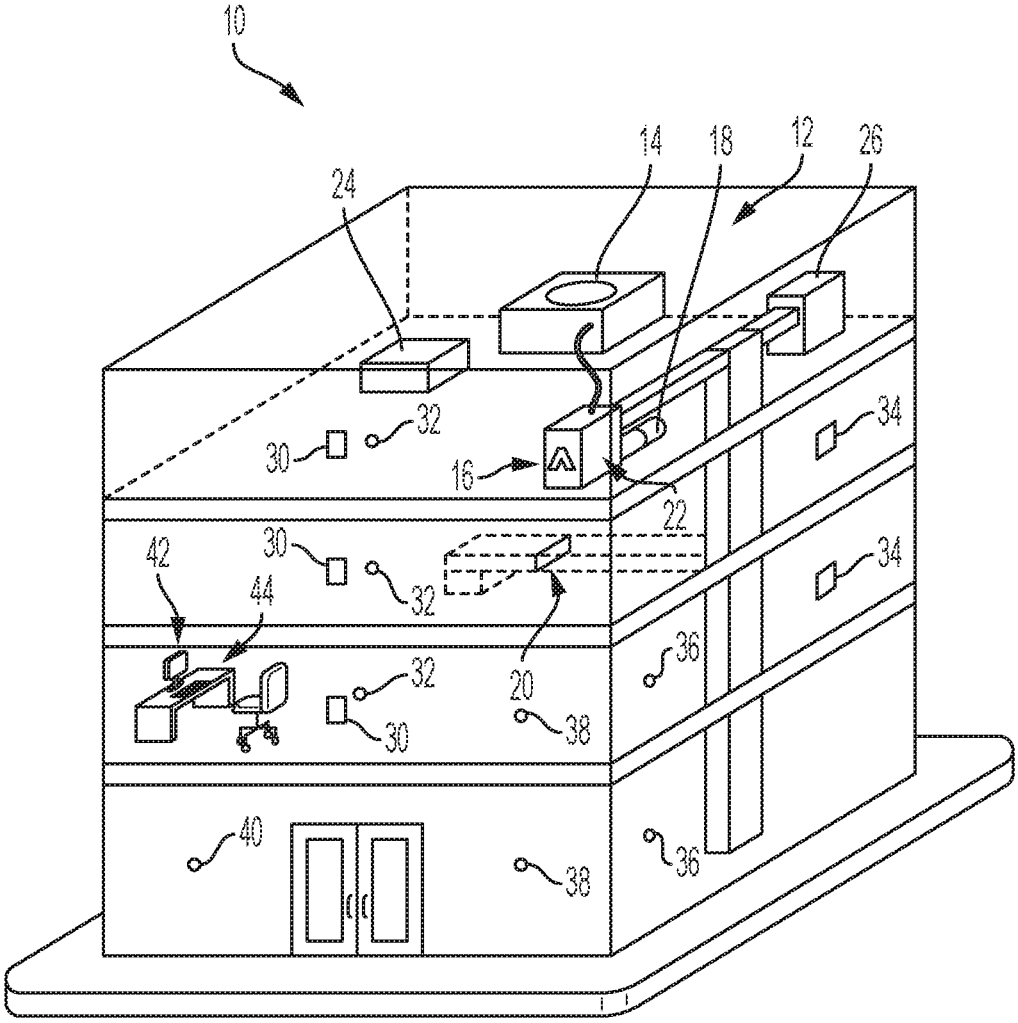
FIG. 1 is a schematic diagram of a building equipped with system for controlling and monitoring the building's atmospheric environment.

FIG. 1 is a schematic diagram of a building equipped with system for controlling and monitoring the building's atmospheric environment. In FIG. 1, building 10 is equipped with atmospheric-environment control system 12. Atmospheric-environment control system 12 can include a great many building-atmosphere components, including, for example, components that controls, affects and/or senses one or more metrics of the atmospheric environment. The atmospheric-environment metrics controlled, affected, and/or sensed by the various components of the atmospheric environment control system can be grouped into three categories: i) thermal-comfort metrics; ii) ventilation metrics; and iii) air-quality metrics. Thermal-comfort metrics, may include, for example, temperature and humidity of the air within building 10. Ventilation metrics may include, for example, carbon dioxide concentration in the air within building 10. Air-quality metrics may include, for example, particulate concentration, particulate size distribution, total volatile organic compound (hereinafter "TVOC") concentration, and a Radon concentration. All these concentrations pertain to the air within building 10.

In the FIG. 1 depicted embodiment, atmospheric-environment control system 12 includes the following building-atmosphere components: air-conditioning compressor 14; air-conditioning evaporator 16; fan 18; damper valves 20;

furnace 22; heat exchanger 24; humidifier 26; temperature sensors 30; humidity sensors 32; carbon dioxide sensors 34; particulate size detectors 36; total volatile organic compound detectors 38; and radon detectors 40. Atmospheric-environment control system 12 includes building-atmosphere control system 42 and building-atmosphere scoring system 44. Building-atmosphere control system 42 coordinates the building-atmosphere components so as to provide a building's atmospheric environment that is healthy and pleasant for persons who work or visit therein. Building-atmosphere scoring system 44 calculates a score for the building's atmospheric environment based on signals received from the various sensors and detectors listed above. Building-atmosphere scoring system 44 can provide building-atmosphere control system 42 various scores pertaining to various zones of building 10 and/or a single score for the atmospheric environment of building 10. Such scores provided to building-atmosphere control system 42 can be used by building-atmosphere control system 42 to optimize the atmospheric environment within building 10.

FIG. 2 is a chart that displays how a composite score can be determined from sensors providing metrics of thermal comfort, ventilation, and air quality. In FIG. 2, chart 50 includes sections A, B, C, and D. Section A lists the thermal-comfort metrics, the ventilation metrics, and the air-quality metrics, in sub-sections A1, A2, and A3, respectively. In some embodiments, additional categories of atmospheric-environment metrics can be added to those listed in section A.

In sub-section A1, the thermal-comfort metrics are temperature and humidity. Signals indicative of measured temperature and humidity are provided to building-atmosphere scoring system 44. In some embodiments the signals indicative of temperature and humidity are used independently, and in other embodiments are used in combination. For example, a Predicted Mean Vote (PMV) can be calculated based on a combination of temperature and humidity measurements. The PMV can be calculated using a proprietary method or any publicly available PMV calculation tool, such as, for example, the pythermalcomfort library, or the Farina, A. PMV Calculator 2015. In some embodiments, additional metrics can be added to the thermal-comfort metrics, such as, for example, air speed. Air speed also can be used either independently or in combination with the temperature metric and/or the humidity metric.

In sub-section A2, the ventilation metrics include only a single metric—carbon dioxide concentration. In other embodiments, additional metrics can be included in the ventilation metrics. For example, another ventilation metric could be a measure or a rate of outside air supplied to the building (e.g., which may be provided in units of cubic feet per minute).

In sub-section A3, the air-quality metrics listed are: particulate concentration of particles having a dimension equal to or less than 2.5 microns (PM 2.5); Total Volatile Organic Compound (TVOC) concentration; and Radon concentration. In other embodiments, additional or fewer metrics can be used to determine an overall air-quality metric. For example, other toxins or pollutants can be detected by sensors configured to detect such toxins or pollutants. In some embodiments particulate concentration of particles having dimensions equal to or less than 10 microns (PM 10) may be detected and used to determine the overall air-quality metric.

Section B of chart 50 discloses how the individual metrics as detected by the various sensors and detectors are normalized. Three different normalization standards are disclosed: i) an enhanced threshold; ii) and acceptable threshold; and iii) a warning threshold. The normalization goes as follows. Each of the individual metrics as detected by the various sensors and detectors are given a score of 75 when the sensed metric is equal to an acceptable threshold. In a similar fashion, each of the individual metrics as detected by the various sensors and detectors are given a score of 90 when the sensed metric is equal to an enhanced threshold. Again, each of the individual metrics as detected by the various sensors and detectors are given a score of 60 when the sensed metric is equal to a warning threshold. Although in the depicted embodiment, the normalized score for metrics equal to the acceptable, enhanced, and warning thresholds is 75, 90, and 60, other normalized scores can be used in other embodiments. The order of the normalized scores, however, will be from highest to lowest from enhanced threshold through acceptable threshold to warning threshold. Furthermore, dissimilar metrics are normalized to the same score, whether it be 75 in the depicted embodiment or some other value, for metrics equal to their respective acceptable threshold.

The acceptable, enhanced, and warning thresholds may be provided by one or more of various standards for a building's atmospheric environment. For example, the International Well Building Institute's V2 Certification Program has published many such thresholds. Other sources can be used to provide guidance pertaining to such thresholds, including government agencies, such as the Environmental Protection Agency (EPA), and international standards, such as the International Standard Organization (ISO). Metrics, for which none of the various standards for a building's atmospheric environment provides such an acceptable level, can leverage experts in the disciplines relevant to provide particular thresholds.

Section B of chart 50 provides exemplary values, obtained from such authorities identified above, for the enhanced, acceptable, and warning thresholds of each atmospheric-environment metric. For example, the acceptable, enhanced, and warning thresholds for carbon dioxide concentration are 900, 750, and 1000 parts per million, respectively, and the acceptable, enhanced, and warning thresholds for TVOC concentration are 500, 200, and 2000 $\mu g/m^3$, respectively. Thus, for any atmospheric-environment metric that is equal to one of the thresholds—the acceptable threshold, the enhanced threshold, or the warning threshold—a score is given—75, 90, or 60, respectively. For any atmospheric-environment metric that is not equal to one of these thresholds, scores will be computed as will be described below with reference to FIG. 3 and section C of chart 50 of FIG. 2.

Figure 3:
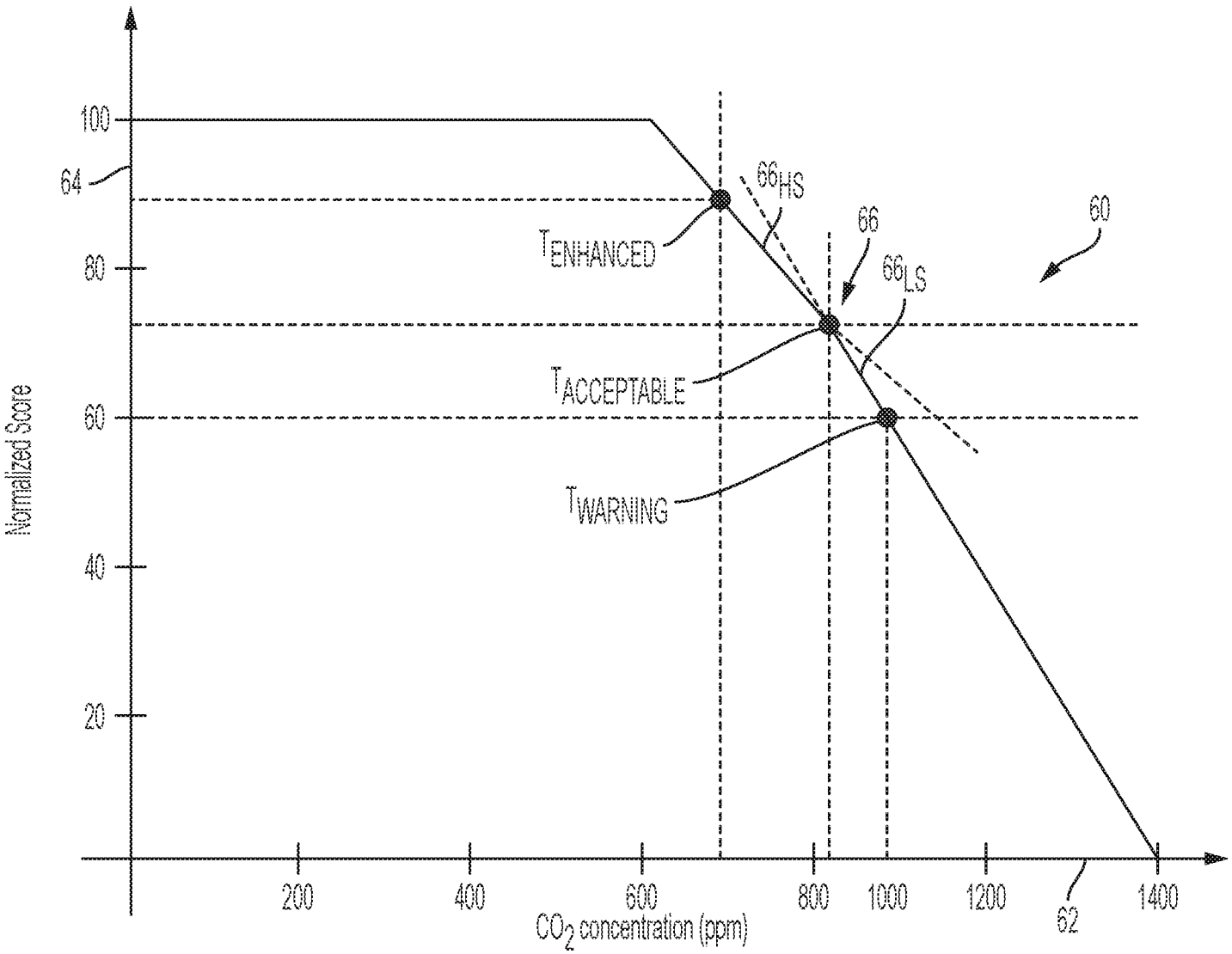
FIG. 3 is a graph of a bi-linear relation for assigning scores to measured atmospheric-environment metrics.

FIG. 3 is a graph of a bi-linear relation for assigning scores to measured atmospheric-environment metrics. Graph 60 is an example of a bilinear relation between one of the atmospheric-environment metrics included in chart 50 of FIG. 2—carbon dioxide—and the score assigned thereto. Graph 60 includes horizontal axis 62, vertical axis 64, and concentration-score relation 66. Horizontal axis 62 is indicative of carbon-dioxide concentration in parts per million (ppm). Vertical axis 64 is indicative of normalized score (unitless). Acceptable, enhanced, and warning threshold-score relations are indicated on graph 60, as $T_{ACCEPTABLE}$, $T_{ENHANCED}$ and $T_{WARNING}$, respectively. Concentration-score relation 66 is bilinear with two linear portions—high-score portion $\mathbf{66}_{HS}$, and a low-score portion $\mathbf{66}_{LS}$. High-score portion $\mathbf{66}_{HS}$ can be created by describing a line that passes through both the acceptable threshold-score relation $T_{ACCEPTABLE}$ and the enhanced threshold-score relation $T_{EN-}$ HANCED. Low-score portion $66_{LS}$ can be created by describing a line that passes through both the acceptable threshold-score relation $T_{ACCEPTABLE}$ and the warning threshold-score relation $T_{WARNING}$.

Concentration-score relation 66 is saturated at score values of 0 and 100 where low-score portion $66_{LS}$ and high-score portion $66_{HS}$ cross such saturation values at $S_{LOW}$ and $S_{HIGH}$ locations on graph 60. Thus, for all carbon-dioxide concentration measurements below 650 ppm, a score of 100 is assigned, and for all carbon-dioxide concentration measurements above 1400 ppm, a score of 0 is assigned. For each of the other atmospheric-environment metrics, a bilinear relation is similarly constructed. Each of high-score portion $66_{HS}$ and low-score portion $66_{LS}$, can be described in standard format:

$$y=mx+b. \quad (1)$$

Here, y represents the score assigned to the atmospheric-environment metric x. the coefficients m and b are given in section C of chart 50. In section C, subscript HIGH identifies the m and b coefficients corresponding to high-score portion $66_{HS}$, and subscript LOW identifies the m and b coefficients corresponding to low-score portion $66_{LS}$.

Section D describes how the individual normalized scores are combined to form a single composite score indicative of the building's atmospheric environment. In the embodiment described by chart 50, a single air-quality score is calculated based on the normalized scores of the particulate concentration PM 2.5, the TVOC concentration, and Radon concentration measurements. The minimum of the three normalized measurements of these three concentrations is selected as the normalized score as representative of air quality. In other embodiments the individual normalized metrics can be combined using a weighted average, such as, for example, a weighted arithmetic average. In other embodiments a weighted geometric average can be used to combine individual normalized metrics.

A weighted average of the individual scores representative of thermal comfort, ventilation, and air quality creates a single composite score representative of atmospheric-environment quality for the entire building. Such a composite score can provide a metric, from which a person can readily ascertain quality of the building's atmospheric environment. Furthermore, such a composite score can be compared with a threshold. Should a building's composite score drop below such a threshold, an automated control system can perform remedial actions that are configured to improve the atmospheric environment, and thus improve the composite score. In some embodiments, individual normalized scores can be compared with a threshold for actionable response. For example, if the normalized score for carbon-dioxide concentration were to fall below 75, a remedial action could be triggered. The normalization of scores for different metrics can be done so as to permit a common trigger threshold for remedial action.

Figure 4:
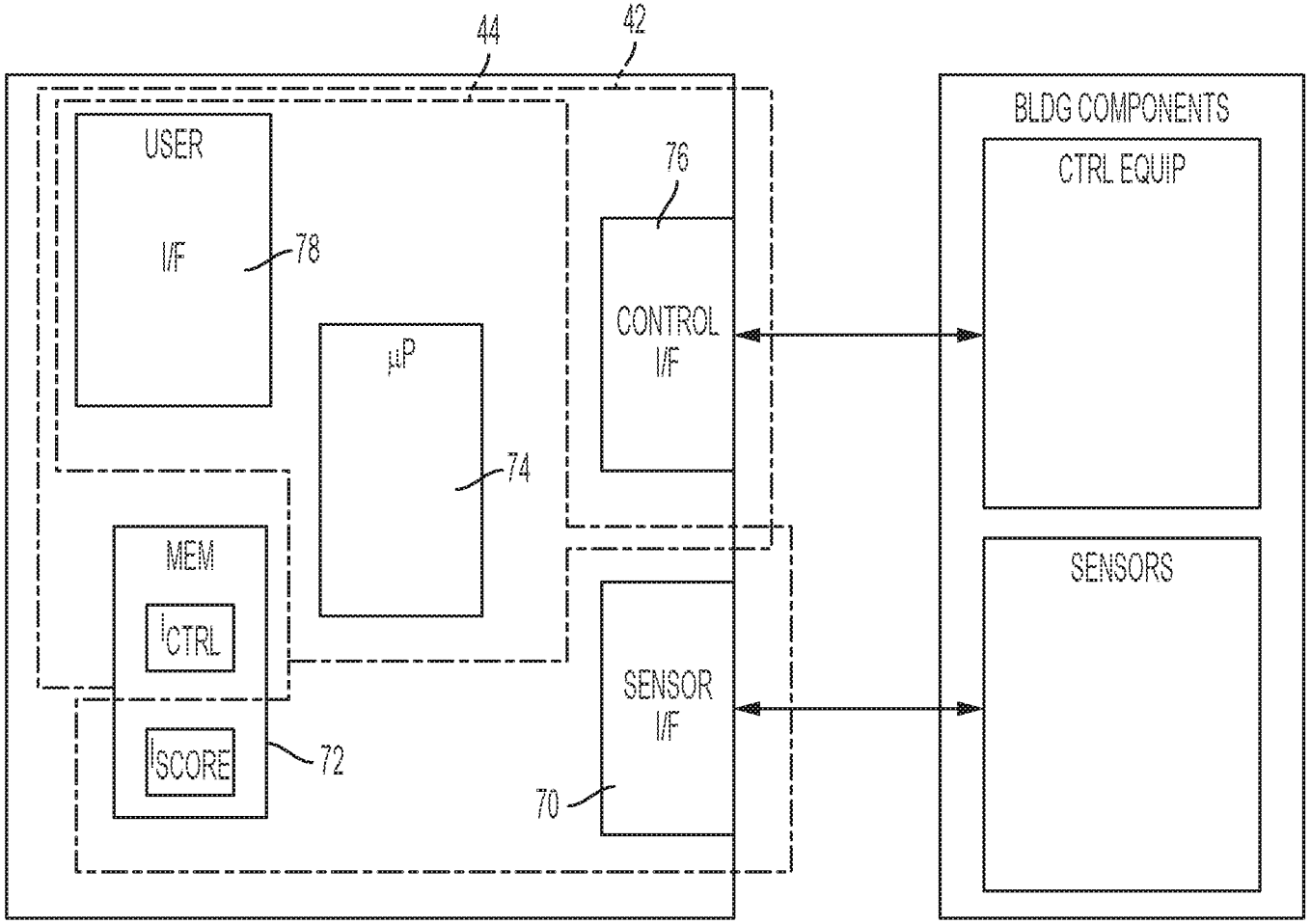
FIG. 4 is a block diagram of an embodiment of a system for assessing an atmospheric environment in the building.

FIG. 4 is a block diagram of an embodiment of a system for assessing an atmospheric environment in the building. In FIG. 4, atmospheric-environment control system 12 includes building-atmosphere control system 42 and building-atmosphere scoring system 44. Building-atmosphere control system 42 and building-atmosphere scoring system 44 share many of the resources depicted in FIG. 4.

Atmospheric-environment control system 12 includes: sensor interface 70; computer readable memory 72; processor 74; control interface 76; and user interface 78. Processor 74 can be configured to perform operations pertaining to each of building-atmosphere control system 42 and building-atmosphere scoring system 44. Similarly, computer readable memory 72 can include program instructions $I_{CTRL}$ and $I_{SCORE}$ pertaining to building-atmosphere control system 42 operations and building-atmosphere scoring system 44 operations, respectively.

To perform functions pertaining to building-atmosphere scoring system 44, processor 74 reads program instructions $I_{SCORE}$ from computer readable memory 72, which cause processor 74 to receive signals sensed and/or detected by various sensors and/or detectors via sensor interface 76. These received sensor signals include signals indicative of each of thermal comfort, ventilation, and air quality. Program instructions $I_{SCORE}$ then cause processor 74 to convert the received signals indicative of each of thermal comfort, ventilation, and air quality to normalized scores indicative of each of thermal comfort, ventilation, and air quality, respectively. Program instructions $I_{SCORE}$ then cause processor 74 to combine the normalized scores of each of thermal comfort, ventilation, and air quality to a single composite score indicative of the atmospheric environment in the building. Program instructions $I_{SCORE}$ then cause processor 74 to send a signal indicative of the composite score to a display device so as to provide notification of the atmospheric environment to a user. Examples of processor 70 can include any one or more of a microprocessor, a controller, a digital signal processor (DSP), an application specific integrated circuit (ASIC), a field-programmable gate array (FPGA), or other equivalent discrete or integrated logic circuitry.

To perform functions pertaining to another embodiment of building-atmosphere scoring system 44, processor 74 reads program instructions $I_{SCORE}$ from computer readable memory 72, which cause processor 74 to receive a first plurality of signals from a first plurality of sensors, each of the first plurality of signals indicative of thermal comfort in a corresponding one of a plurality of building zones. Program instructions $I_{SCORE}$ then cause processor 74 to receive a second plurality of signals from a second plurality of sensors, each of the second plurality of signals indicative of ventilation in the corresponding one of the plurality of building zones. Program instructions $I_{SCORE}$ then cause processor 74 to receive a third plurality of signals from a third plurality of sensors, each of the third plurality of signals indicative of air quality in the corresponding one of the plurality of building zones. Program instructions $I_{SCORE}$ then cause processor 74 to convert corresponding ones of the received first, second, and third plurality of signals to first, second, and third pluralities of normalized scores, respectively. Program instructions $I_{SCORE}$ then cause processor 74 to combine the first, second, and third pluralities of normalized scores to a plurality of composite scores indicative of the atmospheric environment in the corresponding one of the plurality of building zones. Program instructions $I_{SCORE}$ then cause processor 74 to send signals indicative of the plurality of composite scores to a display device so as to provide notification of the atmospheric environment in at least one of the plurality of building zones to a user. In some embodiments, the display device can be a display device dedicated to building-atmosphere control system 42 and/or building-atmosphere scoring system 44. In some embodiments the display device can be that of a mobile device, on which a mobile application communicates with processor 74 over a wireless network.

In either of the two embodiments described above, the computer-readable memory can include further instructions that are configured to cause processor 74 to perform additional operations, both for building-atmosphere control and for building-atmosphere scoring. For example, the computer-readable memory can be encoded with instructions that, when executed by the processor, causes the system to send a signal to equipment that effects a change in one of thermal comfort, ventilation, and air quality. For example, the signal sent to the equipment can be configured to cause an increase in supply of outdoor air to the atmospheric environment in the building or to cause an increase in ventilation of the atmospheric environment in the building. In some embodiments, the computer-readable memory can be encoded with instructions that, when executed by the processor, causes the system to modify a right and/or a privilege of building access based on the combined score. The right and/or privilege modified can reduce access to the building by a group controlled by a building access control system.

Computer-readable memory 72 can be configured to store information obtained and/or computed during operation of atmospheric-environment control system 12. Computer-readable memory 72, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, computer-readable memory 72 is a temporary memory, meaning that a primary purpose of computer-readable memory 72 is not long-term storage. Computer-readable memory 72, in some examples, is described as volatile memory, meaning that computer-readable memory 72 do not maintain stored contents when power to atmospheric-environment control system 12 is turned off. Examples of volatile memories can include random-access memories (RAM), dynamic random-access memories (DRAM), static random-access memories (SRAM), and other forms of volatile memories. In some examples, computer-readable memory 72 is used to store program instructions for execution by processor 70. Computer-readable memory 72, in one example, is used by software or applications running on atmospheric-environment control system 12 (e.g., a software program performing building-atmosphere scoring and/or building-atmosphere control) to temporarily store information during program execution.

In some examples, computer-readable memory 72 can also include one or more computer-readable storage media. Computer-readable memory 72 can be configured to store larger amounts of information than volatile memory. Computer-readable memory 72 can further be configured for long-term storage of information. In some examples, computer-readable memory 72 includes non-volatile storage elements. Examples of such non-volatile storage elements can include magnetic hard discs, optical discs, flash memories, or forms of electrically programmable memories (EPROM) or electrically erasable and programmable (EEPROM) memories.

Sensor interface 70 and control interface 76 can be used to communicate information between atmospheric-environment control system 12 and the various building-atmosphere components, for building-atmosphere scoring operation and/or building-atmosphere control operation. Sensor interface 70 and/or control interface 76, in one example, utilizes the communications module to communicate with external devices via one or more networks, such as one or more wireless or wired networks or both. The communications module can be a network interface card, such as an Ethernet card, an optical transceiver, a radio frequency transceiver, or any other type of device that can send and receive information. Other examples of such network interfaces can include Bluetooth, 3G, 4G, and Wi-Fi radio computing devices as well as Universal Serial Bus (USB).

Figure 5:
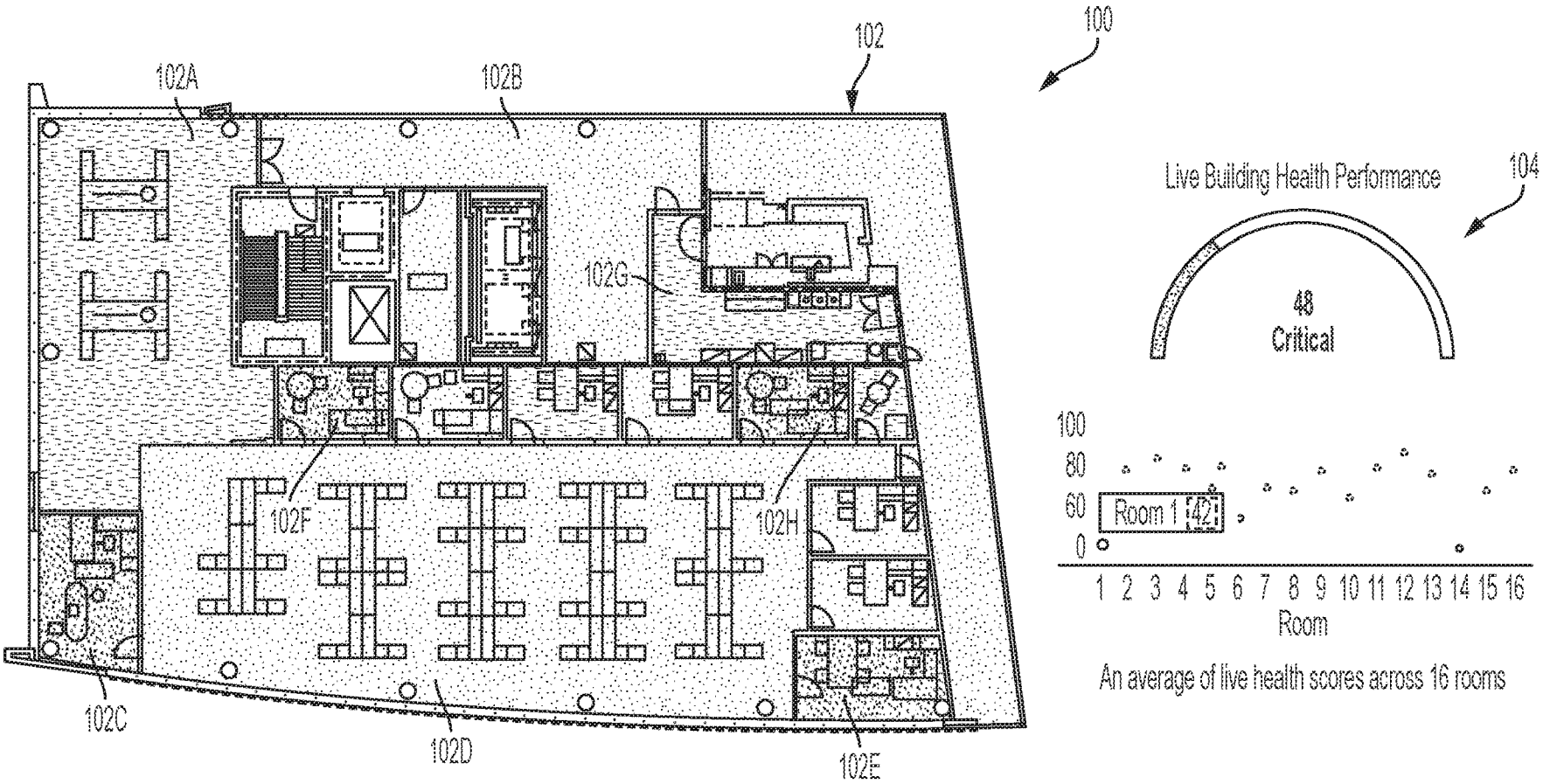
FIG. 5 is a display screen graphic showing an exemplary graphical display of the composite building score along with the normalized scores of various zones within the building.

FIG. 5 is a display screen graphic showing an exemplary graphical display of the composite building score along with the normalized scores of various zones within the building. In FIG. 5, display screen graphic 100 shows building graphic 102 and composite score graphic 104. Building graphic 102 includes building regions 102A-102H, each of which is shaded so as to indicate a normalized atmospheric-environment score pertaining to that building region. Composite score graphic 104 includes a speedometer-like graphic indicating a composite building score of 48 with annotation indicating that such a score is critical. Below the speedometer like graphic is a chart indicating the various normalized atmospheric-environment score pertaining to each building region.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system for scoring an atmospheric environment within a building, the system comprising:

a processor;

computer-readable memory encoded with instructions that, when executed by the processor, causes the system to:

receive a first signal from a first sensor, the first signal indicative of thermal comfort;

receive a second signal from a second sensor, the second signal indicative of ventilation;

receive a third signal from a third sensor, the third signal indicative of air quality;

convert the received first, second, and third signals to first, second, and third normalized scores, respectively, wherein:

the first normalized score is equal to a predetermined normalized acceptable level when the first signal indicates that the thermal comfort is equal to an acceptable thermal comfort level;

the second normalized score is equal to the predetermined normalized acceptable level when the second signal indicates that the ventilation is equal to an acceptable ventilation level; and the third normalized score is equal to a predetermined normalized acceptable level when the third signal indicates that the air quality is equal to an acceptable air quality level, wherein at least one of the acceptable thermal comfort level, the acceptable ventilation level, and the acceptable air quality level are established by a building certification standard; and send a signal to equipment that effects a change in one of thermal comfort, ventilation, or air quality in response to the first, second, or third normalized score, respectively, being less than a trigger threshold for remedial action.

2. The system of claim 1, wherein the first signal indicative of thermal comfort is indicative of at least one of an indoor air temperature and a humidity level.

3. The system of claim 1, wherein the second signal indicative of ventilation is indicative of a carbon dioxide concentration.

4. The system of claim 1, wherein the third signal indicative of air quality is indicative of at least one of a particulate measurement, a total volatile organic compound concentration, and a Radon concentration.

5. The system of claim 1, wherein the computer-readable memory is further encoded with instructions that, when executed by the processor, causes the system to:

combine the first, second, and third normalized scores to a single composite score indicative of the atmospheric environment in the building; and send a signal indicative of the composite score to a display device so as to provide notification of the atmospheric environment to a user.

6. The system of claim 1, wherein the signal sent to the equipment causes an increase in supply of outdoor air to the atmospheric environment in the building.

7. The system of claim 1, wherein the signal sent to the equipment causes an increase in ventilation of the atmospheric environment in the building.

8. The system of claim 5, wherein the display device is a display screen of a mobile phone, and the signal indicative of the composite score is sent to the mobile phone via a wireless network.

9. The system of claim 5, wherein the display device is configured to display the composite score in response to receiving the signal indicative of the composite score.

10. The system of claim 9, wherein the display device is further configured to display an indication of an atmospheric environment quality level corresponding to the composite score.

11. The system of claim 1, wherein each of the first, second, and third normalized scores are bilinear having a first slope for scores better than the acceptable thermal comfort, ventilation, and air quality levels established by the building certification standard, respectively, and each of the first, second, and third normalized scores have a second slope for scores worse than the acceptable thermal comfort, ventilation, and air quality levels established by the building certification standard, respectively.

12. The system of claim 11, wherein the first slope is different from the second slope for each of the first, second, and third normalized scores.

13. The system of claim 5, wherein the combining the first, second, and third normalized scores to form a single composite score indicative of the atmospheric environment in the building is done by:

performing a weighted average of the first, second, and third normalized scores to form the single composite score indicative of the atmospheric environment in the building.

14. A system for scoring an atmospheric environment within a building, the system comprising:

a processor;

computer-readable memory encoded with instructions that, when executed by the processor, causes the system to:

receive a first plurality of signals from a first plurality of sensors, each of the first plurality of signals indicative of thermal comfort in a corresponding one of a plurality of building zones;

receive a second plurality of signals from a second plurality of sensors, each of the second plurality of signals indicative of ventilation in the corresponding one of the plurality of building zones;

receive a third plurality of signals from a third plurality of sensors, each of the third plurality of signals indicative of air quality in the corresponding one of the plurality of building zones;

convert corresponding ones of the received first, second, and third plurality of signals to first, second, and third pluralities of normalized scores, respectively, wherein:

each of the first plurality of normalized scores is equal to a predetermined normalized acceptable level when the first signal indicates that the thermal comfort is equal to an acceptable thermal comfort level;

each of the second plurality of normalized scores is equal to the predetermined normalized acceptable level when the second signal indicates that the ventilation is equal to an acceptable ventilation level; and each of the third plurality of normalized scores is equal to a predetermined normalized acceptable level when the third signal indicates that the air quality is equal to an acceptable air quality level, wherein at least one of the acceptable thermal comfort level, the acceptable ventilation level, and the acceptable air quality level are established by a building certification standard; and send a signal to equipment that effects a change in one of thermal comfort, ventilation, or air quality in response to one of the first, second, or third pluralities of normalized scores, respectively, being less than a trigger threshold for remedial action.

15. The system of claim 14, wherein the computer-readable memory is further encoded with instructions that, when executed by the processor, causes the system to:

make a plurality of comparisons of the plurality of composite scores, each compared to a predetermined acceptable threshold; and determine whether an atmospheric-environment building component is common to building zones corresponding to at least two of the plurality of comparisons that indicates that the atmospheric environment is less than a predetermined acceptable level for that building zone.

16. The system of claim 15, wherein the computer-readable memory is further encoded with instructions that, when executed by the processor, causes the system to:

send, in response to the system determining that an atmospheric-environment building component is common to building zones corresponding to at least two of the plurality of comparisons indicating that the atmospheric environment is less than a predetermined acceptable level for that building, a signal to the common air-quality building component determined so as to change the operating condition of the common atmospheric-environment building component determined.

17. The system of claim 15, wherein the computer-readable memory is further encoded with instructions that, when executed by the processor, causes the system to:

send, in response to the system determining that an atmospheric-environment building component is common to building zones corresponding to at least two of the plurality of comparisons indicating that the atmospheric environment is less than a predetermined acceptable level for that building, a signal that identifies the common atmospheric-environment building component to the display device so as to provide notification to take a maintenance action with regard to the common atmospheric-environment building component.

18. The system of claim 14, wherein the computer-readable memory is further encoded with instructions that, when executed by the processor, causes the system to:

combine the first, second, and third pluralities of normalized scores to a plurality of composite scores indicative of the atmospheric environment in the corresponding one of the plurality of building zones; and send signals indicative of the plurality of composite scores to a display device so as to provide notification of the atmospheric environment in at least one of the plurality of building zones to a user.

19. The system of claim 18, wherein the computer-readable memory is further encoded with instructions that, when executed by the processor, causes the system to:

combine the plurality of composite scores into a single composite score indicative of the atmospheric environment in the building; and sending a signal indicative of the single composite score to the display device so as to provide notification of the atmospheric environment to a user.

20. The system of claim 19, wherein the computer-readable memory is further encoded with instructions that, when executed by the processor, causes the system to:

make a comparison of the composite score and a predetermined acceptable threshold; and send an alert signal to the display device if the comparison made indicates that the atmospheric environment is less than a predetermined acceptable level.

* * * * *